United States Patent [19]

Schedele

[11] 4,377,798

[45] Mar. 22, 1983

[54] ELECTROMAGNETIC RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 272,665

[22] Filed: Jun. 11, 1981

[30] Foreign Application Priority Data

Jul. 8, 1980 [DE] Fed. Rep. of Germany ..... 3025814

[51] Int. Cl.[3] ..... H01H 51/28

[52] U.S. Cl. ..... 335/202; 335/128

[58] Field of Search ..... 335/202, 154, 128, 187, 335/132

[56] References Cited

U.S. PATENT DOCUMENTS 3,544,930 12/1970 Sauer ..... 335/154

4,087,667 5/1978 Heider et al. ..... 200/245

*Primary Examiner*—Harold Broome

[57] ABSTRACT

An electromagnetic relay has a coil spool having a hollow interior serving as a chamber for a number of relay contact elements which are actuated by a flat armature. A contact mount carrying contact springs is inserted into the coil spool at an open end thereof, with the opposite end of the coil spool being closed by an end wall having stationary contact elements embedded therein. The coil spool has an opening beneath the winding for adjustment purposes, which is sealed by a foil prior to the application of the winding.

7 Claims, 4 Drawing Figures

ELECTROMAGNETIC RELAY

BACKGROUND OF THE INVENTION

1. Field of the Invention

The present invention relates to electromagnetic relays and in particular to an electromagnetic relay with contact elements disposed in a contact chamber within a hollow coil spool in approximately axially parallel relation and which are actuated by a flat armature also in the chamber.

2. Description of the Prior Art

An electromagnetic relay having contact elements which are arranged in a contact chamber within a 1-piece coil body is known, for example, from German AS No. 16 39 417. The contacts are disposed approximately axially parallel and are moved by a flat armature. The relay has a number of stationary counter contact elements which cooperatively function with associated contact springs disposed opposite to a respective counter contact element. The counter contact elements project into the contact chamber and overlap one another at their contact ends. A portion of the contact elements together with a yoke plate and an armature mounted thereupon are supported by a contact mount which is inserted into one end of the coil body opening. The two contact carriers provided in the embodiment of German As No. 16 39 417 are, however, approximately disc shaped and are inserted into the coil body flange. The short length over which the coil body flange and the contact mount engage presents the danger that the pole pieces or plates supported by the two contact mounts will not be in precise alignment with one another so that the armature does not rest flat over its entire length. This structure presents the additional danger that the interacting contact elements which are inserted from opposite directions will be subject to high tolerances with regard to the contact spacings. Readjustment of the contact spacings following assembly of the contact carriers is, however, not possible with this structure.

Another exemplary embodiment disclosed in German AS No. 16 39 417 employs a single contact mount which carries all contact elements and pole pieces and is inserted from one side into the coil spool. In this embodiment, despite the fact that the contact spacings may be adjusted prior to insertion, there is the disadvantage that at least on one flange side of the spool the terminals of the set of springs must be subsequently bent over the synthetic edge of the mount. In addition, the assembly of all of the components on a single contact mount is time consuming and difficult.

SUMMARY OF THE INVENTION

It is an object of the present invention to provide an electromagnetic relay of the type described above which has as few parts as possible which are required for supporting and fixing the contact elements, as a result of which the assembly of the relay necessitates the least possible number of steps.

It is a further object of the present invention to provide an electromagnetic relay having a contact chamber which, following assembly of the contact elements therein, is still accessible for purposes of adjustment and which may be sealed in a simple manner after such adjustment as is needed.

The above objects are inventively achieved in an electromagnetic relay having a coil spool with only one open end. The coil spool has an open end for accommodating a contact mount, whereas the stationary counter contact elements and/or contact springs which project into the contact chamber from the opposite end of the coil spool are embedded in an end wall and run parallel to the coil axis. The end wall forms an integral part of the coil spool. The contact chamber has an opening, which is subsequently covered by the coil winding, which permits access to the contact-making ends of the contact elements for adjustment thereof after those elements have been assembled.

The above structure of an end wall closed on one side with contact elements embedded therein in axial parallel fashion insures that only the contact elements which are arranged opposite to one another are supported by a mount and must be plugged in with the mount. Such a structure simplifies the assembly process considerably. Moreover, a simplification in production is achieved by the radial opening in the coil spool, in particular when the coil tube possesses openings on two opposite sides. By means of these openings the contact elements can be maintained in the correct position during injection casting of the coil body and, under certain circumstances, can also be protected from impurities. The radial opening in the coil spool also permits access to the overall contact arrangement following assembly for purposes of adjustment. An opening of this type can be easily covered and sealed because the coil winding is wound over this region, and thus insures a reliable seal.

In one embodiment of the invention the contact mount is comprised of insulating material and has a U-shape. The side flanks of the contact mount, which enclose the associated contact elements, may each run in guide grooves of the coil spool which extend into the region of the center of the coil. This results in particularly good guidance and dimensionally accurate fixing of the inserted contact elements. This guide means furthermore allows the yoke plate, which is connected to the contact mount, and the armature also mounted thereupon to be brought into a dimensionally accurate position relative to the contact elements.

In the closed end wall of the coil spool a plurality of contact elements may be embedded in one plane next to one another, for example, by an injection molding process. The ends of the contact elements which emerge from the outside of the coil spool are preferably shaped to form terminal pins and are bent at right angles. In a further embodiment of the invention the coil connecting elements are also embedded into the end wall of the coil spool, preferably in the same plane as the contact elements. The central part of such coil connecting elements is embedded in the wall, whereas the two free ends emerge from the outside of the coil spool and are bent at right angles with respect to the embedding plane, but in directions opposite to one another, in order to serve as carriers for the ends of the windings and as terminal pins as well. The terminal pins of the coil connecting elements lead to the bottom, that is to the connection side, of the relay approximately parallel to the terminal pins of the contact elements, whereas in opposing fashion the carriers of the winding ends are bent upwards. These connecting elements which are bent outside the coil spool are preferably accommodated by channels which are formed in the coil body so that the connecting elements do not project beyond the end surface of the coil body.

All of the contact elements and coil connecting elements are preferably punched from a common sheet of metal and the terminal pins are brought to the correct grid section and are bent appropriately. Because it is generally undesirable to arrange all the terminal pins at the end side of the relay in one row, the terminal pins in the present invention may be brought to a desired grid point on the bottom of the relay by bending at an angle.

The radial opening in the coil spool is preferably sealed by an insulating foil prior to the application of the winding. It is also preferable for a counter pole plate which cooperates with the armature to be inserted subsequently through a recess in the otherwise closed end wall of the coil spool. In the same manner as the contact mount inserted on the opposite side, the opening in this counter pole plate can be sealed by additional measures such as, for example, by the use of wool which is subsequently saturated with a thin sealing agent.

DESCRIPTION OF THE PREFERRED EMBODIMENTS

Figure 1:
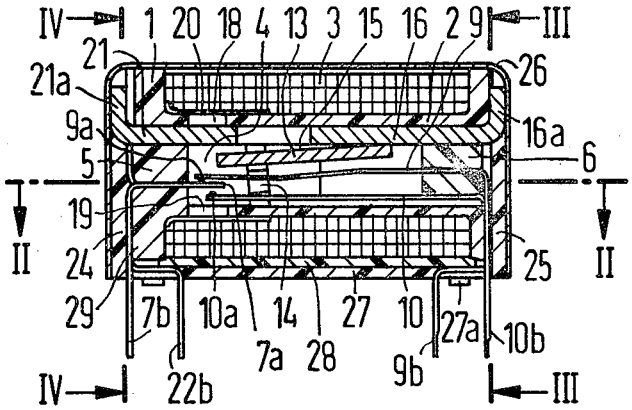
FIG. 1 is a sectional view from the side of a relay constructed in accordance with the principles of the present invention.
Figure 2:
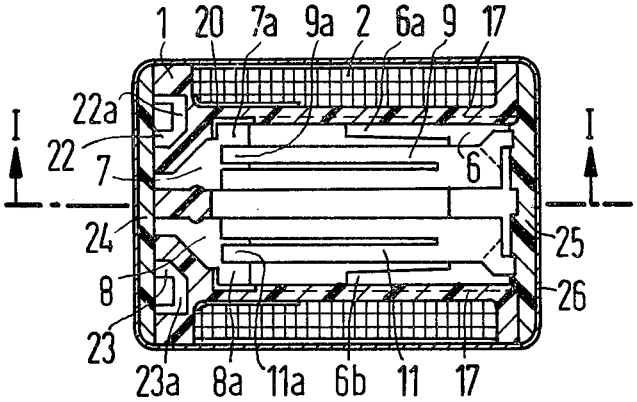
FIG. 2 is a sectional view taken along line II—II of FIG. 1 and showing the section for FIG. 1 along line I—I.
Figure 3:
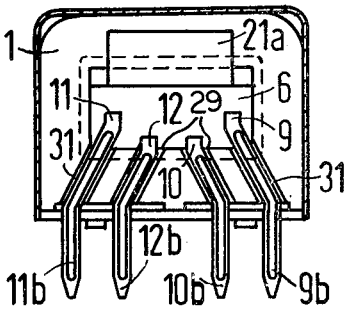
FIG. 3 is a sectional view taken along line III—III of FIG. 1.
Figure 4:
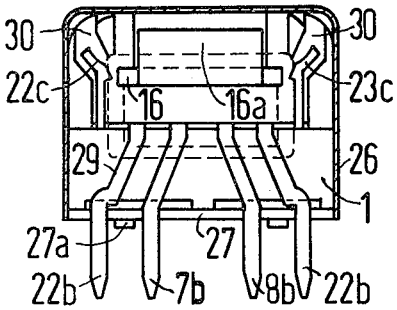
FIG. 4 is a sectional view taken along line IV—IV of FIG. 4.

An electromagnetic relay is shown in a side sectional view in FIG. 1. The relay has a coil spool 1 having a central hollow coil tube 2 about which a winding 3 is wound. A contact chamber 4 is formed in the interior of the coil tube 2. At one end (the left end of FIG. 1) the contact chamber 4 is closed by an end wall 5 formed in the coil body 1, whereas the opposite end displays an opening which serves to accommodate a contact mount 6.

Axially parallel contact elements 7 and 8 are embedded, for example, by injection molding, into the end wall 5 and the free ends 7*a* and 8*a* of the contact elements 7 and 8 project into the contact chamber 4 where they form a stationary central contact. The opposite free ends of the contacts 7 and 8 exit from the wall 5 of the coil body 1 and form terminal pins 7*b* and 8*b* which are bent downward at right angles to the coil axis.

In the embodiment shown in FIG. 1 the contact mount 6 carries two pairs of contact springs, a pair referenced at 9 and 10 and a pair referenced at 11 and 12. The pairs are secured in the contact mount 6, for example, by injection or the like. The contact-making ends of the contact springs 9, 10, 11 and 12 overlap the central contacts 7*a* and 8*a* and thus form two make-and-break contacts. The spring contacts are actuated by an armature 13 via an actuating element 14. The actuating element 14 may be molded onto the armature or attached thereto by another suitable fashion. The armature 13 is mounted by a bearing spring 15 on a yoke plate 16 which is inserted, together with the contact mount 6, into the coil tube 2. The yoke plate 16 may be connected to the contact mount 6 by riveting or any other suitable means and can be inserted, together with the mount 6, into the coil body 1. Guide grooves 17 in the coil body 1 insure precise positioning of the contact mount 6 and of the pole plate 16 within the relay as well as fixing the dimensional relationship of the two components with respect to one another.

During assembly of the relay, the contact mount 6 together with the pole plate 16 and the armature 13 mounted thereupon are axially inserted into the coil body 1. In order to simplify assembly, the upper contact springs 9 and 11 are each longer than the lower contact springs 10 and 12. In order to facilitate insertion of the assembly, the armature 13 can be first caused to pull up by an externally applied magnetic field so that the contact-making ends 9*a* and 11*a* lie across the central contacts 7*a* and 8*a*. Before the insertion process is continued the armature 13 is permitted to drop so that the contact-making end 10*a* (as well as the contact-making end for the contact spring 12, which cannot be seen in FIG. 1) can be brought past the central contacts 7*a* and 8*a*.

In order to facilitate adjustment of both the embedded and inserted contact elements with respect to one another, the coil tube 2 has radial openings 18 and 19 in the region of the contact chamber 4 where the contact ends abut. A suitable test to determine proper alignment can be effected through these openings and appropriate adjustment tools inserted therein to realign and readjust the contact elements if necessary. Prior to the application of the winding 3 the openings 18 and 19 can be sealed by an insulating foil 20 which is positioned around the coil tube 2, for example, in tubular or sleeve form.

The armature 13 cooperates with a counter pole plate 21 which, in alignment with the yoke plate 16, is inserted through the end wall 5 into an appropriately corresponding recess. This operation is undertaken preferably following adjustment because the opening 18 is sealed by this counter pole plate 21. It is possible, however, to additionally embed the counter pole plate 21 in the coil body 1, in which case only the opening 19 would be provided for adjustment purposes.

Coil connecting elements 22 and 23 are also embedded in the end wall 5 in one plane with the contact elements 7 and 8. Of these coil connecting elements only the central portions 22*a* and 23*a* thereof are embedded, whereas the two free ends each emerge from the end wall 5. The ends 22*b* and 23*b* are bent downward together with the contact terminals 7*b* and 8*b* and serve as coil terminal pins. The opposite ends 22*c* and 23*c* are bent upward and serve as carriers for the winding ends of the coil 3. Both the contact elements 7 and 8 and the coil terminals 22 and 23 are commonly punched from one sheet of metal and are embedded into the coil body in one plane. By appropriate shaping of the terminal pins, the pins are brought into the provided grid section along the end side of the relay. In the embodiment shown the coil terminal pins 22*b* and 23*b* are additionally bent at an angle on the bottom of the relay in order to reach a grid point which is offset from the end of the relay. The terminal pins 9*b* and 11*b* of the contact springs 9 and 11 are respectively also bent at a similar angle. The end wall 5 of the coil body 1 is provided with channels 30 for accommodating the coil terminals 22*c* and 23*c* and the contact mount 6 is provided with channels 29 for accommodating the terminals 12 and 10 and channels 31 for accommodating the terminals 11 and 9.

The end sides of the coil body are sealed by wool foils 24 and 25 saturated in a casting resin. A ferromagnetic cap is inverted over the relay and serves as a flux plate between the yoke plate 16 and the counter pole plate 21. The angled ends 16*a* of the yoke plate and 21*a* of the counter pole plate serve to provide a better coupling. A base plate 27 provided with spacing projections 27*a* is placed over the terminal pins. If necessary the entire relay may be filled with casting resin in the cap 26. For this purpose a resin-pouring opening (not shown in the drawings) may be provided in the base plate 27.

Although modifications and changes may be suggested by those skilled in the art it is the intention of the inventor to embody within the patent warranted hereon all changes and modifications as reasonably and properly come within the scope of his contribution to the art.

I claim as my invention:

1. An electromagnetic relay comprising:

a one-piece coil body having a hollow interior forming a contact chamber inside said relay and about which an electromagnetic coil is wound, said coil body having one open end communicating with said contact chamber and an opposite end closed by a vertical wall integrally formed with said coil body;

a plurality of movable spring contact elements disposed in said contact chamber substantially axially parallel to one another;

a plurality of stationary counter contact elements disposed in said contact chamber for making and breaking with said movable spring contact elements, said movable spring contact elements and said counter contact elements projecting into said contact chamber from opposite ends thereof and overlapping at their respective contact-making ends;

a contact mount inserted and fitted in said open end of said coil body for carrying said movable contact elements, said stationary counter contact elements being embedded in said vertical wall;

a yoke plate and an armature for actuating said movable spring contact elements, said yoke plate and said armature also mounted on said contact mount; and said coil body having at least one radial opening communicating with said contact chamber in a region of said contact-making ends of said movable and stationary contact elements, said opening permitting adjustment and alignment of said contact elements in said contact chamber after assembly thereof and said opening being subsequently covered by said electromagnetic coil winding.

2. The relay of claim 1 wherein said contact mount is comprised of insulating material and has a U-shape with a pair of side flanks which extend into said contact chamber and at least partially enclose said movable contact elements, said coil body having a pair of guide grooves in said contact chamber for receiving said side flanks for precisely positioning and fixing said carrier mount and said contact elements carried thereby.

3. The relay of claim 1 wherein said plurality of counter contact elements are embedded in a single plane in said vertical wall of said coil body, said counter contact elements having a portion thereof extending outside of said coil body, said portions being bent at right angles to said vertical wall for serving as terminals for said counter contact elements.

4. The relay of claim 1 further comprising at least two coil connecting elements each having a central portion embedded in said vertical wall of said coil body and each having two free ends which exit from said coil body, said two free ends of each coil connecting element being bent at opposing right angles with respect to a plane in which said central portion is embedded for serving as carriers and terminal pins for the ends of said electromagnetic coil winding.

5. The relay of claim 4 further comprising a plurality of channels in said carrier mount and said vertical wall for accommodating and guiding each of said contact elements and coil connecting elements to an exterior of said relay.

6. The relay of claim 1 further comprising an insulating foil applied beneath said winding for sealing said radial opening in said coil body.

7. The relay of claim 1 further comprising a counter pole plate in said contact chamber, and wherein said vertical wall of said coil body has an axially parallel opening for accommodating and guiding said counter pole plate in said contact chamber.

* * * * *